US006347490B1

(12) United States Patent
Spengler

(10) Patent No.: US 6,347,490 B1
(45) Date of Patent: Feb. 19, 2002

(54) DOCKING SYSTEM FOR A BIOBUBBLE CLEAN ROOM

(75) Inventor: Charles Wm. Spengler, Fort Collins, CO (US)

(73) Assignee: bioBubble, Inc., Fort Collins, CO (US)

( * ) Notice: Subject to any disclaimer, the term of this patent is extended or adjusted under 35 U.S.C. 154(b) by 0 days.

(21) Appl. No.: 09/290,866

(22) Filed: Apr. 14, 1999

(51) Int. Cl.[7] ..... E06B 7/00

(52) U.S. Cl. ..... 52/173.2; 52/DIG. 13; 454/187; 428/100; 160/90

(58) Field of Search ..... 52/2.12, 173.1, 52/173.2, DIG. 13, 202, 203; 49/483.1; 277/906, 637; 454/187; 55/356; 428/100; 160/90

(56) References Cited

U.S. PATENT DOCUMENTS 3,464,094 A * 9/1969 Mates
3,585,569 A * 6/1971 Moran
4,028,855 A * 6/1977 Prewer ..... 52/272
4,304,224 A * 12/1981 Fortney ..... 55/215
4,426,816 A * 1/1984 Dean et al. ..... 52/202
4,485,489 A * 12/1984 Pilie et al.
4,791,236 A * 12/1988 Klein ..... 174/36
4,842,916 A * 6/1989 Ogawa et al.
4,883,512 A * 11/1989 Griffis ..... 55/356
4,964,249 A * 10/1990 Payne ..... 52/70
4,971,130 A * 11/1990 Bentley
5,062,871 A * 11/1991 Lemon ..... 55/259
5,080,701 A * 1/1992 Howard et al. ..... 52/356
5,081,748 A * 1/1992 Eberle
5,277,654 A * 1/1994 Fenn ..... 454/141
5,306,861 A * 4/1994 Amos ..... 52/63
5,412,918 A * 5/1995 Wendel ..... 52/582.1
5,558,112 A * 9/1996 Strieter ..... 52/63
5,766,723 A * 6/1998 Oborny et al. ..... 428/100
5,819,474 A * 10/1998 Strom ..... 52/4
5,953,868 A * 9/1999 Giuliani ..... 52/173.2
5,960,847 A * 10/1999 Crider et al.
5,967,464 A * 10/1999 Miyoshi
6,065,253 A * 5/2000 Ojeda ..... 52/79.9
6,145,686 A * 11/2000 Stinson

FOREIGN PATENT DOCUMENTS

FR 1300206 * 6/1962 ..... 52/DIG. 13

* cited by examiner

*Primary Examiner*—Robert Canfield
(74) *Attorney, Agent, or Firm*—Ronald E. Greigg

(57) ABSTRACT

An airlock extension made of a plasticized material of an accordion type structure which is secured between a clean room and an autoclavable container to overcome the need for an accurate alignment. The airlock extension has a vinyl sheet which extends across the extension to form two separate areas. The vinyl sheet is secured in place by a hook and loop connection which permits easy placement of the vinyl sheet to form two separate areas. The hook and loop strips are provided with parallel spaced rows of loops or hooks and include a compressible gasket between the rows which form a good seal when the hooks and loops are pressed together. The strips of hooks and loops form an easy way of securing the airlock extension the vinyl clean room and a container.

8 Claims, 4 Drawing Sheets

DOCKING SYSTEM FOR A BIOBUBBLE CLEAN ROOM

This invention is directed to an airlock extension for a docking system for a vinyl-sided clean room and more particularly for delivery of sterile materials from a non-sterile autoclave-transport unit into a clean room.

Today's research often involves the housing and maintenance of large numbers of rodents that require sterile conditions. These specialized rodent types include gnotobiotic, transgenic, and severely compromised immunodeficient (SCID) to name a few. Commercial breeding and maintenance colonies of these animals can be particularly large in size. Large quantities of sterilized bedding, caging, feeding and watering must be provided in caring for these animals.

In the past, various types of docking systems were used to deliver the sterile items to the animal room. These systems used mechanical means, which had to be very accurately aligned, to make a positive seal. This method limited the size and volume of material that could be delivered to the animal housing room. These systems were not conducive to supplying very large rooms.

A known system for delivering sterile products to a clean room has been set forth by U.S. Pat. No. 4,304,224 to Fortney. One operational drawback to the Fortney system is the limited capacity to deliver a large quantity of sterilized materials. This system used stainless steel cylinders (approximately 30-gallon capacity) to hold and deliver the sterilized items. The cylinders had to be accurately aligned by mechanical means to a mating port on the clean room structure. This was both labor intensive and greatly limited the quantity of feed, water, and bedding which could be delivered at one time.

SUMMARY OF THE INVENTION

One purpose of the bioBubble Clean Room with the inventive docking system is to allow the user to deliver autoclave materials directly to the clean room without having to bring the non-sterile autoclave-transport unit into the clean room. The docking system includes a section of flexible plasticized fabric material which can be moved to different small angles so that a large, heavy stainless steel container of autoclaved materials can be delivered to the clean air room and thereafter dirty bedding and other soiled items can be loaded back into the large container for processing those items.

This patent application describes one container attached to the airlock. But it would be possible use the invention to attach one container to each side of the vinyl-sided clean room. A compressible gasket is another means of attaching the autoclave container without complicated mechanical attachments. It does not have to be perfectly aligned or straight to work properly.

It also takes minimal physical strength to perform attachment. It only takes one person to attach the invention to an autoclave and a clean room where prior art mechanical attachments would take two persons on an autoclave container of this size intended to function with the invention. The invention also minimizes the leakages of the sterilant mist.

OBJECT OF THE INVENTION

It is therefore an object of the invention to provide a docking system by which non-sterile large containers containing sterile items can be docked with a clean room for adding sterile products to the clean room and for removing waste items from the clean room.

Another object is to provide a docking system for a clean room which easily can be adjusted for connecting a large non-sterile container to the clean room.

Still another object is to provide a docking system which permits large amounts of autoclaved materials, such as feed, water, and bedding, to be efficiently delivered to vinyl-sided clean rooms.

Yet another object is to permit the use of large containers to be used which contain large numbers of sterile items to be transferred to a clean vinyl-sided room without contaminating the sterile items nor the clean vinyl-sided room.

While still another object is to provide a docking system within which personnel can operate to transfer sterile items from a large container containing sterile items without contaminating the clean air room.

Still a further object is to provide a novel sealing gasket means to improve the seals achieved between mating flexible surfaces of the clean room and the extension, and between the extension and the autoclavable container.

Other objects and advantages of the invention will become clear to those skilled in the art from reviewing the drawings and specification.

DETAILED DESCRIPTION

Figure 1:
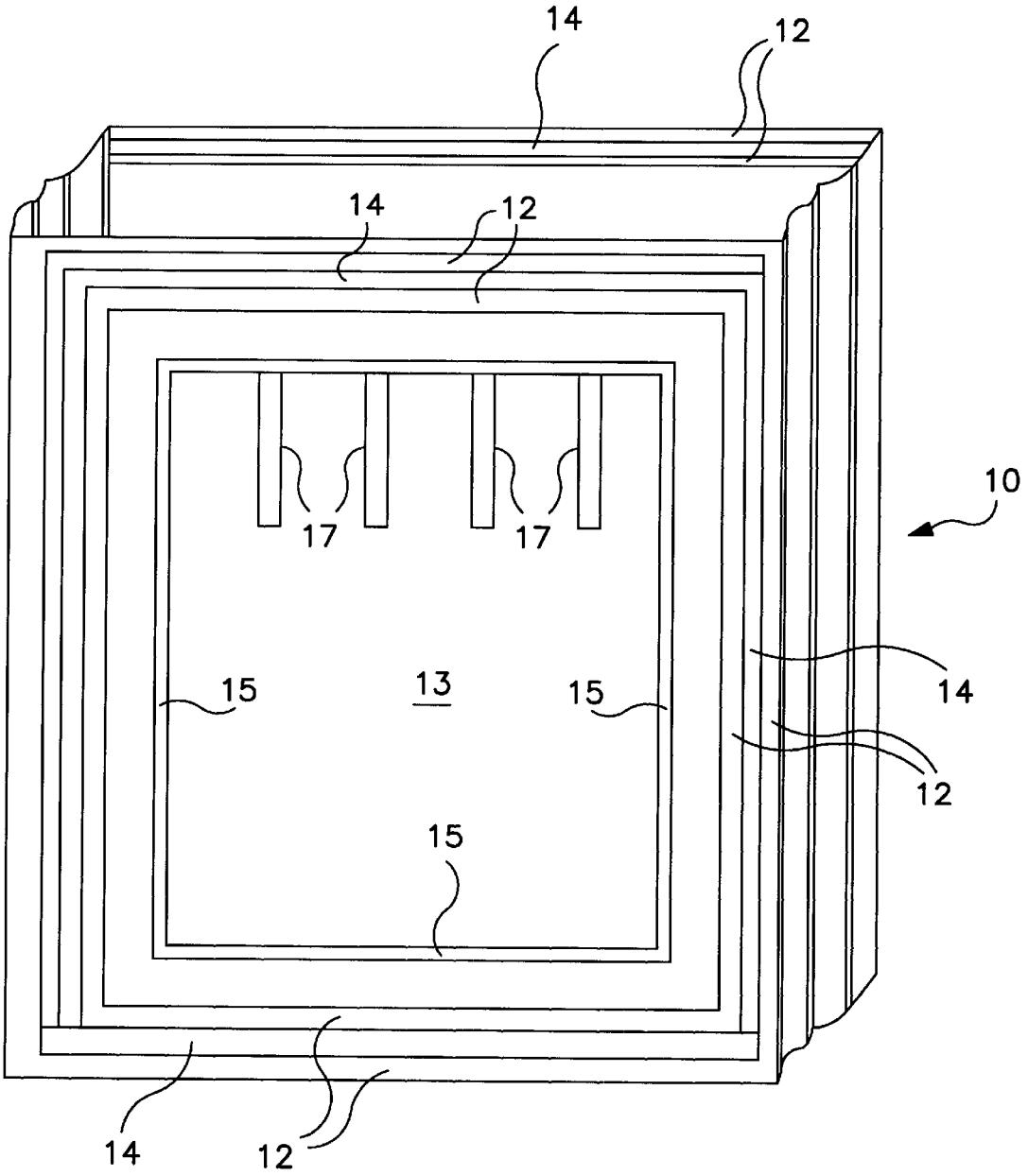
FIG. 1 is a front perspective view of an air lock extension.

Now referring to the drawings wherein the same reference characters represent the same parts throughout the drawings, FIG. 1 illustrates a front perspective view of a plastic airlock extension 10 for connecting an autoclavable container to a vinyl-sided clean room which is well known in the art. The air lock extension is made of plastic in somewhat an accordion style so that the air lock extension can be secured to one surface of a vinyl clean room by use of hooks or loops 12 which are known as VELCRO™ connection. It is well known that the hooks are on one surface and the loops are on another surface so that as the two surfaces are pressed together the two pieces will be secured together. In FIG. 1 the air lock extension is shown with hooks or loops 12 along the back surface which are secured to hooks or loops, now known, on the vinyl clean room. Not shown in FIG. 1 are hooks or loops that are secured along the entire circumference of the air lock extension and which are connected to corresponding surfaces of the vinyl-sided clean room by either hooks or loops as required.

There are two parallel rows of hooks or loops 12 shown in FIG. 1 in which in one the hooks or loops are separated by a strip of compressible gasket material 14 or the gap therebetween is a void, free of hooks, loops or other appendages. The air lock extension shown in FIG. 1 includes an inner vinyl sheet 13 which is secured across a front portion of the airlock extension by a single row of hooks and loops 15 which are along the sides and bottom of the sheet. The upper edge of the vinyl sheet is fixedly secured to the air lock extension. As will be described later, the vinyl sheet 13 can be disconnected from the hooks or loops and rolled up and held in an up position by strips 17 that have loops on one surface and hooks on an opposite surface. The hooks and loops are pressed together after the vinyl sheet is rolled up.

Figure 2:
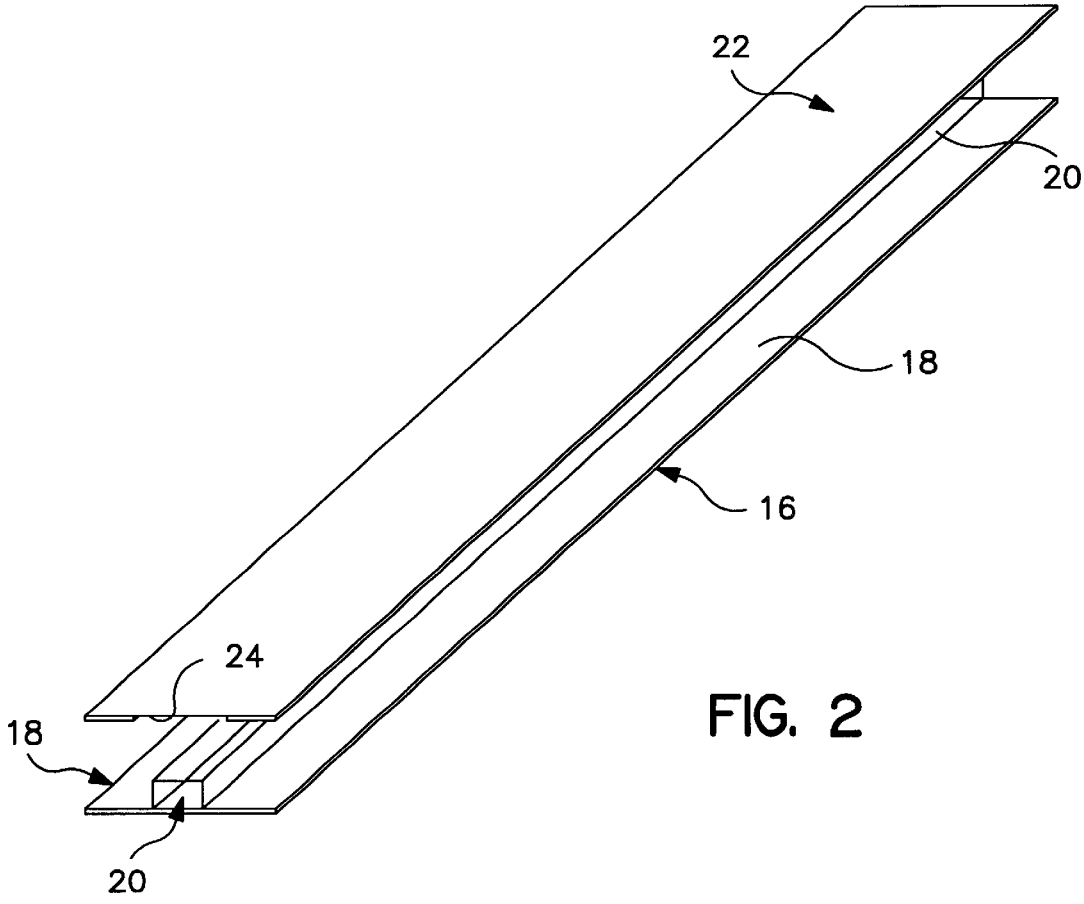
FIG. 2 illustrates a strip of a pair of strips of hooks and loops separated from each other by a compressible gasket.

A strip of hooks and loops (such as VELCRO™) is shown in FIG. 2. As shown, the strip 16 includes either hooks or loops 18 which are separated by a compressible gasket 20. The hooks or loops and the gasket are substantially the same width, whereas the thickness of the compressible gasket is at least twice as thick as the hook or loop strips and preferably more than twice the thickness. The upper strip 22 includes either hooks or loops which have a spacing 24 between the hooks or loops. The spacing is the same width as that of the compressible gasket so that when the two strips are pressed together, the compressible gasket will be sandwiched between the hooks or loops of the strip 22. It should be obvious to one skilled in the art that if one strip 18 has loops then the strip 22 would have hooks. In use of the VELCRO™ strips as shown in FIG. 2, one strip is secured to the circumference of the air lock extension and the other strip is secured to the surface of the vinyl clean room. The compressible gasket can be between the hooks or loops secured to the air lock extension or between the hooks and loops secured to the surface of the vinyl clean room.

In order to secure the front of the air lock extension to the front of an autoclavable container, the circumference of the front of the air lock extension is provided with hooks or loops 12 and, as shown, a compressible gasket between the hooks or loops.

Figure 3:
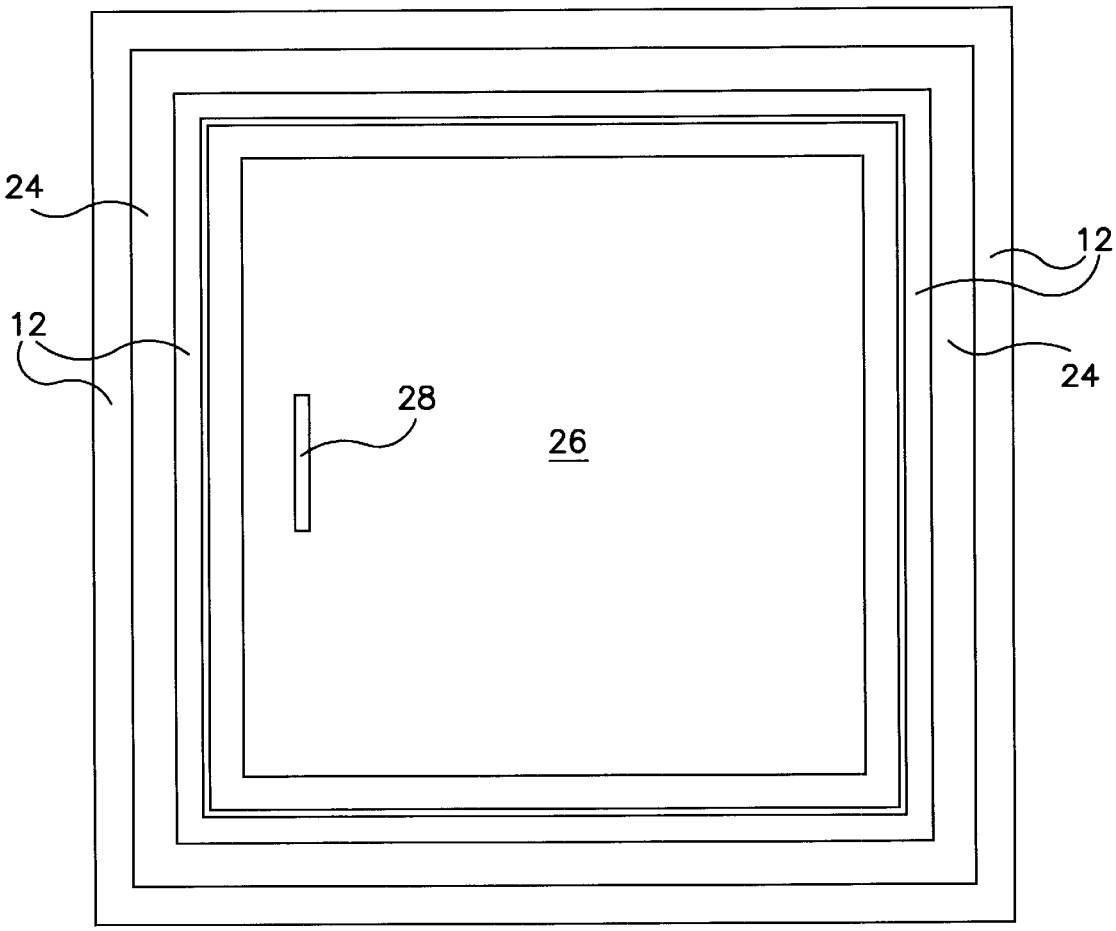
FIG. 3 illustrates a front view of an autoclavable container to which an air lock extension is to be fastened.

FIG. 3 illustrates a front surface of an autoclavable container which is provided with hooks or loops 12 and a space 24 between the hooks or loops into which the compressible gasket on the front of the air lock etiiion fits when the two strips of loops and hooks are pressed together to secure the air lock extension to the autoclavable container. The container is shown with a door 26 which can be opened and closed by a handle 28.

Applicant has determined that parallel rows of hooks and loops with a gasket between the rows provides a greater seal against loss of positive pressure or a negative pressure, and minimizes loss of sterilant mist.

Figure 4:
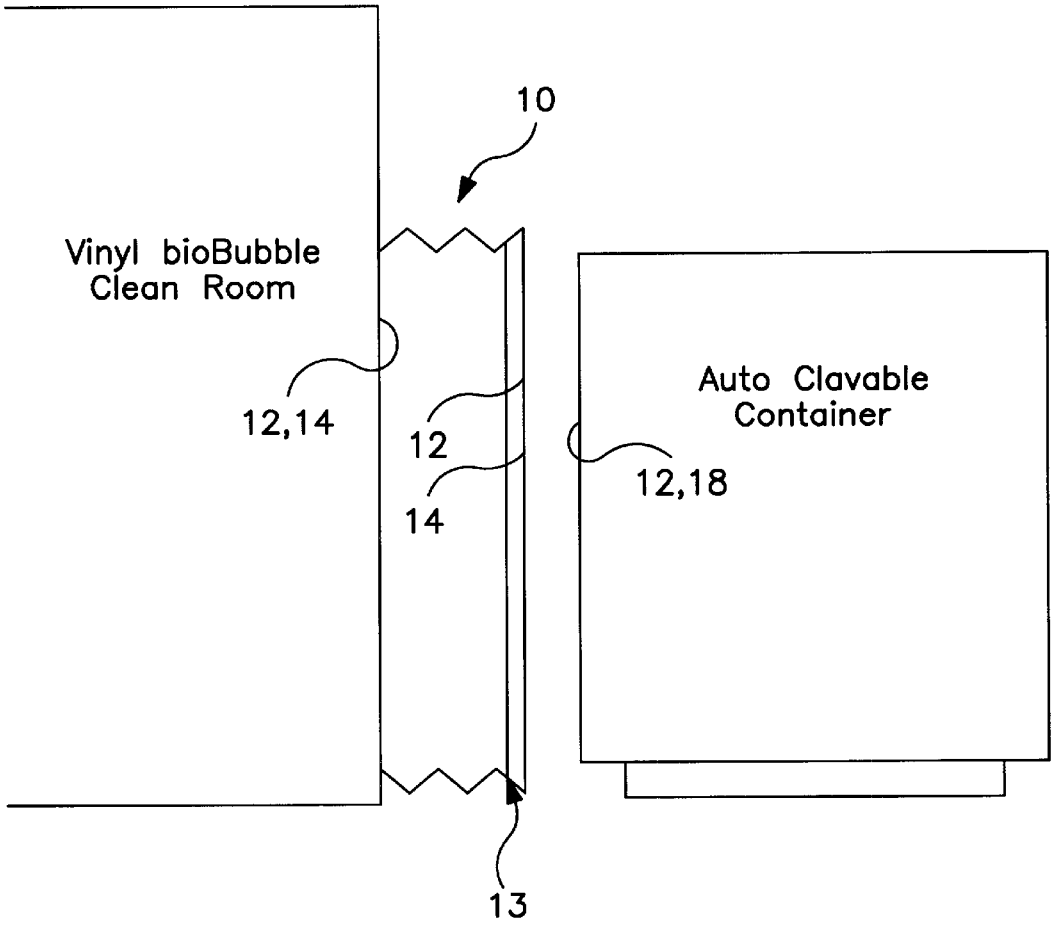
FIG. 4 is a schematic side view which represents an airlock extension secured to a vinyl-sided clean air room for securing to an autoclavable container.

FIG. 4 illustrates a schematic side view of a vinyl clean room with an airlock extension secured thereto in position to be secured to an autoclavable container. The VELCRO™ connection of the airlock extension is not shown in FIG. 4 but it is understood that the airlock extension is secured to the vinyl clean room along the circumference of the airlock extension. The airlock extension is secured to the autoclavable container by suitable hook and loop strips shown in FIG. 2.

In operation and use of the airlock extension, the airlock extension is secured to a surface of a vinyl clean room on a surface that is provided with a door or opening. The airlock extension can be connected to the surface of the vinyl clean room and stored there with the inner vinyl layer secured in a down position. Therefore, the airlock extension will not interfere with access to the vinyl-sided clean room. The airlock extension is used for adding sterile items to the vinyl clean room and for moving dirty and/or soiled items from the vinyl clean room. It is known in the art that vinyl clean rooms can be under either positive or negative pressure. The use of the airlock extension can be used for either negative or positive pressure vinyl clean rooms. Dependent upon the type of pressurized environment, a reversed operation of the airlock extension which should be obvious to those skilled in the art. Use of the airlock extension for positive air pressure is as follows:

The autoclave container is loaded with feed, water or bedding.

After the container has run through the sterilization cycle and has been removed from the autoclave, it is moved to the clean room.

The operator extends the accordion docking device and attaches it to the face of the autoclave container via the VELCRO™-gasket combination. The container and the docking device have opposing VELCRO™-type connections.

The clear vinyl layer is in a down position and fixed with the VELCRO™ connection 15 of the airlock extension.

A liquid sterilant, such as Clidox™ by Pharmacal, is misted into the space between the clear vinyl and the front of the autoclave container door.

After the sterilant manufacturer's prescribed length of time for sterilization to occur, the clear vinyl sheet is lifted (rolled up).

The operator opens the autoclave container door, exposing the sterilized contents to the sterile clean room interior.

Dirty bedding and cages are exchanged for clean materials. The soiled items are loaded into the autoclave container.

The container door is sealed.

The clear vinyl is rolled down and the VELCRO™ connection 15 is sealed.

The container is detached from the docking unit.

The container is then removed to the appropriate room for processing of soiled materials.

Once the container has been removed from the airlock extension the access to the vinyl clean room is closed, the vinyl sheet 13 of the airlock extension stays down and the airlock extension can be stored as connected to the vinyl clean room.

Operation for a negative pressure is different from that of a positive pressure operation. In a negative pressure operation before the autoclave container is moved into place, the vinyl sheet 13 of the airlock extension is down and sealed by the VELCRO™ strips. The vinyl sheet must be down and sealed via VELCRO™ when the container is not attached, and is rolled up only after sterilant is misted in the space between the clear vinyl sheet and the autoclave container. If the sheet were rolled up, the airlock would be exposed to atmosphere. The airlock extension is then subjected to negative pressure of the vinyl clean room. After the airlock extension has reached the negative pressure of the vinyl clean room, the autoclave container which has been subjected to sterilization is moved to the airlock extension. the air lock extension is secured to the autoclave container and then the space between the vinyl sheet 13 and the end of the autoclave container is sterilized as set forth above. Subsequent to sterilization of the area between the autoclave container and the vinyl sheet 13, the vinyl sheet is raised, the door of the autoclave container is opened and an exchange of good items for dirty used items can be carried out. Once the exchange of items has been carried out, the door of the autoclave container is closed, the vinyl sheet 13 is lowered and secured in place. The opening to the vinyl clean room is then closed and the vinyl sheet 13 of the airlock extension can be lifted and the airlock extension is secured in place.

In use of an airlock extension of an accordion type permits one to connect the airlock extension to an autoclave container which needs not to be exactly aligned. If the autoclave container is not exactly aligned with the clean room, the airlock extension can be moved either left or right to properly align the airlock extension with the autoclave container. Thus, the airlock extension set forth herein may be adjusted in different directions for proper alignment and connection to an autoclave container.

The drawings are illustrative of an airlock extension which can be secured at one end to a vinyl clean room and at another end to an autoclavable closure. In accordance with the invention, the vinyl clean room can have one strip of a loop or hook secured to an outside circumference. In this case, the airlock extension will have another strip of a loop or hook along an inside circumference of the airlock extension which will secure to the loop or hook strip secured to the outside circumference of the vinyl clean room. In the event the airlock extension is to be secured to a facing of the vinyl clean room, then the loop or hook strip on the airlock extension will be on the outside circumference of the airlock extension. The same arrangement is carried out for the connection to the autoclavable container. The compressible gasket can be included on either of the hook and loop strips.

What is claimed is:

1. An airlock extension for connecting a clean room with a container, which airlock extension comprises:

a plasticized fabric material which forms an enclosure with oppositely disposed first and second open ends, said first and second open ends are provided with edges having loops or hooks along their circumference, which hooks or loops at one end are connectable to respective hooks or loops provided on edges of compatible surfaces of said clean room, and said enclosure includes a plastic sheet which has ends and edges, said plastic sheet being secured along one of its ends to said enclosure, and said edges having loops or hooks which are connectable to compatible portions of said enclosure which have respective hooks or loops to form two separate sections in said enclosure.

2. An air lock extension as set forth in claim 1, in which said enclosure includes strips (17) secured along said one end of said plastic sheet which is secured to said enclosure, said strips (17) include hooks or loops on opposite sides, and said plastic sheet is rollable on itself and securable in an up position by said strips (17) in order to store said plastic sheet in a raised position.

3. An airlock extension as set forth in claim 1, in which said first open end of said enclosure is securable to said clean room, and said second open end of said enclosure is securable to said container.

4. An airlock extension as set forth in claim 2, in which said first open end of said enclosure is securable to said clean room, and said second open end of said enclosure is securable to said container.

5. A combination airlock extension and a sealable loop and hook connection for connecting a clean room with a container, which comprises:

a plasticized fabric material which forms an enclosure with oppositely disposed first and second open ends, said first and second open ends are provided with edges having loops or hooks along their circumference which are connectable to hooks or loops on edges of a compatible surface of said clean room, said enclosure includes a plastic sheet which has ends and edges, said plastic sheet being secured along one of its ends to said enclosure, and said edges having loops or hooks which are connectable to compatible hooks or loops on a portion of said enclosure to form two separate sections in said enclosure, said loop and hook connections include a first elongated strip having parallel rows of hooks or loops spaced apart from each other and a second elongated strip having parallel rows of hooks or loops spaced apart from each other with a same spacing as said first strip, and a strip of compressible gasket filling the spacing between said parallel rows of hooks or loops of one of said first and second parallel rows of hooks or loops.

6. An airlock extension as set forth in claim 5, in which said enclosure includes strips (17) secured along said one end of plastic sheet which is secured to said enclosure, said strips (17) include hooks or loops on opposite sides, and said plastic sheet is rollable on itself and securable in a raised position by said strips (17) in order to store said plastic sheet in an up position.

7. An airlock extension as set forth in claim 5, in which said first open end of said enclosure is securable to said clean room, and said second open end of said enclosure is securable to said container.

8. An airlock extension as set forth in claim 6, in which said first open end of said enclosure is securable to said clean room, and said second open end of said enclosure is securable to said container.

* * * * *